US005878884A

United States Patent [19]

Mayled

[11] Patent Number: 5,878,884

[45] Date of Patent: Mar. 9, 1999

[54] MAGAZINE TRACK SLIDER PACKAGE

[76] Inventor: Edward C. Mayled, 28 Groveland Crescent, Brampton, Ontario, Canada, L6S 1L2

[21] Appl. No.: 867,445

[22] Filed: Jun. 2, 1997

Related U.S. Application Data

[63] Continuation of Ser. No. 526,210, Sep. 11, 1995, abandoned.

[51] Int. Cl.[6] ..... B65D 85/62

[52] U.S. Cl. ..... 206/455; 206/485; 206/775; 206/784

[58] Field of Search ..... 206/454, 455, 206/779, 780, 783, 485, 486, 487, 775, 784

[56] References Cited

U.S. PATENT DOCUMENTS

| | | | |
|---|---|---|---|
| 4,146,127 | 3/1979 | Bayer | 206/485 X |
| 4,381,837 | 5/1983 | Cortopassi | 206/485 |
| 5,497,882 | 3/1996 | Kenyon | 206/485 |

*Primary Examiner*—Jacob K. Ackun
*Attorney, Agent, or Firm*—Edward H. Oldham

[57] ABSTRACT

This invention relates to a package which functions to receive and secure other packages. The package is analogous to a magazine which may be loaded and contain several identical cartridges in a serial fashion. Because the cartridge packages have unified shape and size, the impact of a number of cartridge packages in lined formation in the magazine package is an effective marketing tool.

11 Claims, 3 Drawing Sheets

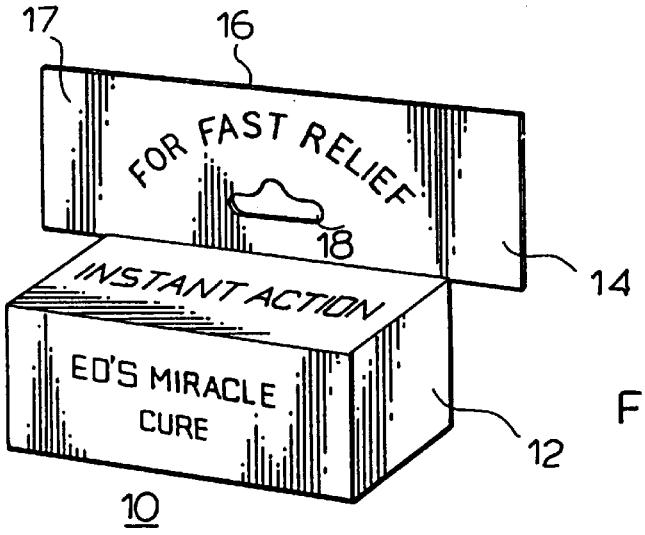
FIG.1.
FIG. 2.
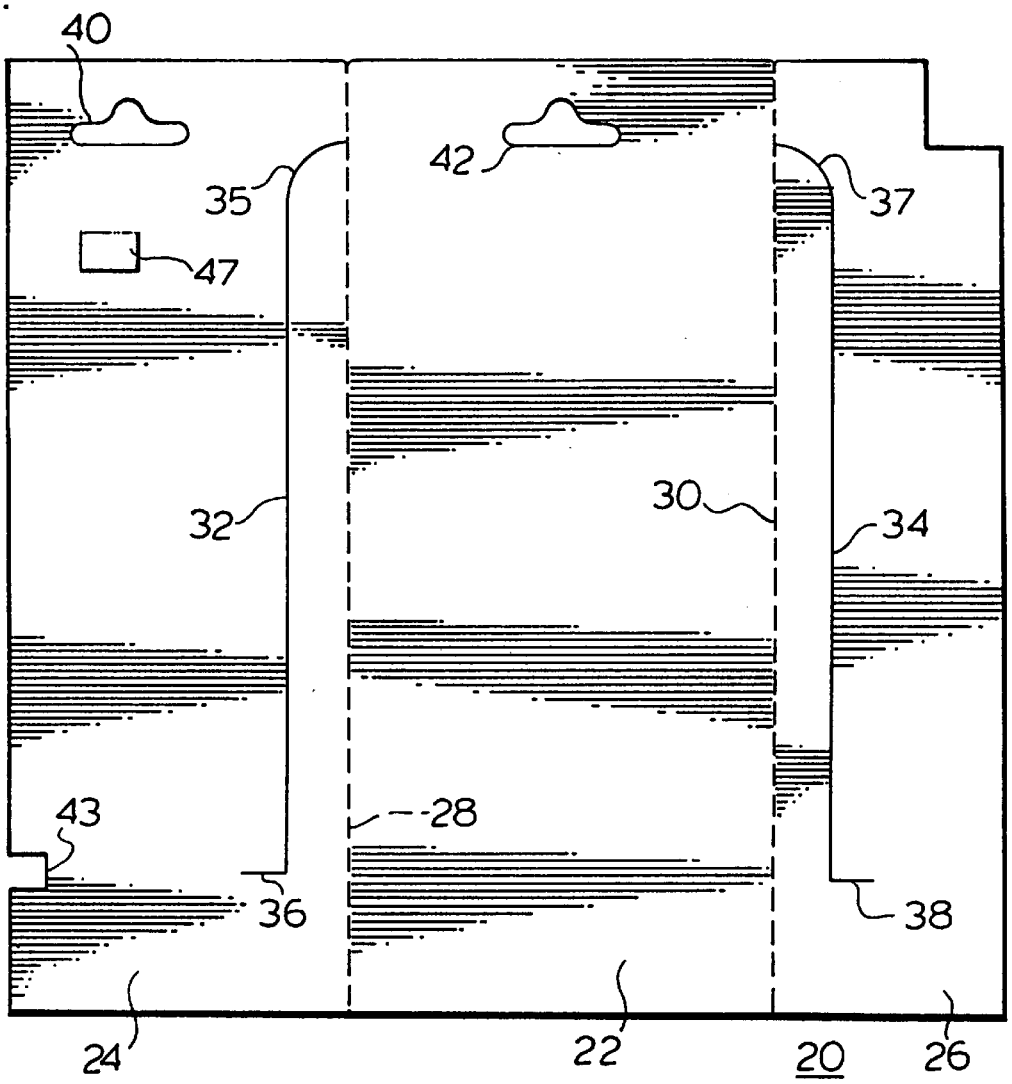

FIG. 3.
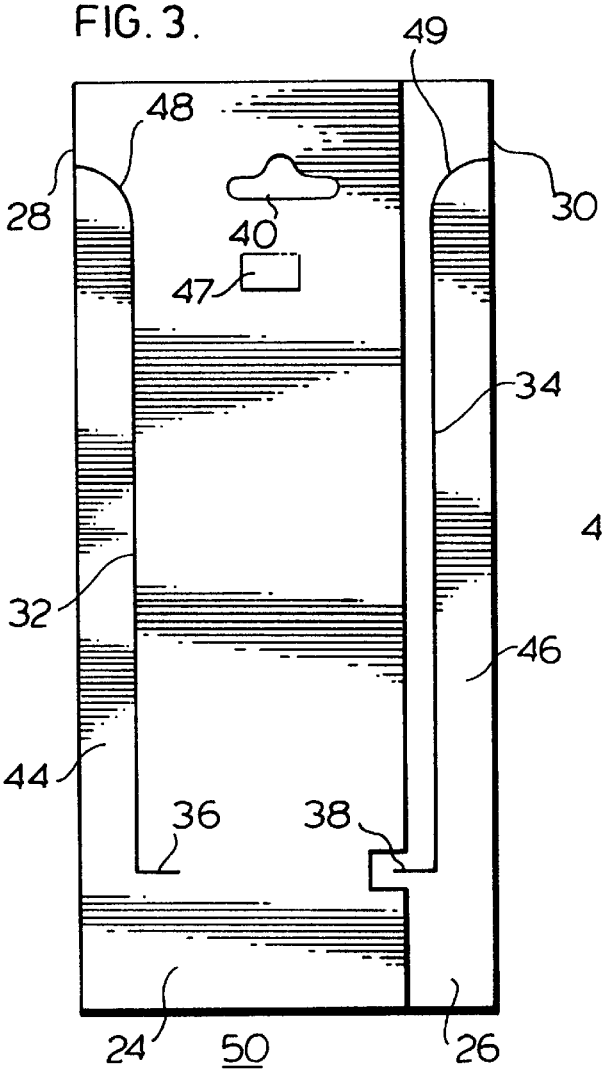
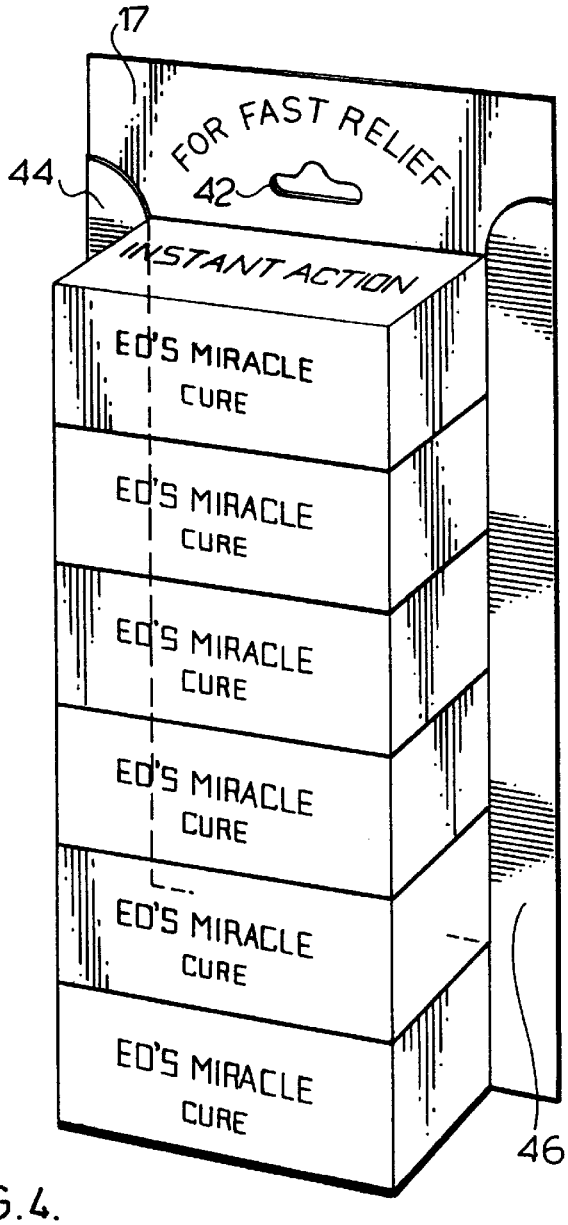
FIG. 4.

MAGAZINE TRACK SLIDER PACKAGE

This application is a continuation of U.S. application Ser. No. 08/526,210 filed Sep. 11, 1995, now abandoned.

The present invention relates to packaging and in an ancillary manner, marketing.

The package to which this invention relates is a package which serves as a receptacle for other packages. As such, this package is capable of accepting other packages in a serial fashion and displaying the packages so received in a manner that is aesthetically pleasing to the consumer.

BACKGROUND OF THE INVENTION

Packaging is an art and at the present time is driven by such diverse forces as marketing, economics and environmental concerns. The product manufacturer is anxious to package a product in a package which will be attractive to the consumer, while at the same time, the consuming public are demanding that packaging materials be minimized, and be, if possible, recyclable, and at the very least be environmentally acceptable from a conservation point of view. The package container thus must therefore be capable of retaining a product through shipping, storage and displaying of the product during the marketing and selling phase at the container's life. It must be robust so as to keep the captive packages so inserted into the containing package in the position without allowing any packages to spill from the package.

OBJECTS OF THE INVENTION

The container of this invention functions as a storage magazine and is capable of accepting products within its confines, and the products so accepted are stored in the package in a compact, stacked, organized manner so as to minimize the packaging material required. Product packages may be slid into a pair of receiving troughs formed in the package for loading the package with products to be displayed. To this end, the package lends itself to being loaded with product packages mechanically, thus avoiding expensive labour intensive packaging procedures.

Once the product packages (cartridges) are inserted into the package of this invention, the product cartridges are held firmly and securely so that the product cartridges are not easily dislodged. Finally, when the desired number of product packages have been inserted into the package of this invention, the entire package is enveloped in a transparent shrink wrap.

In certain circumstances, the materials requiring packaging may be of such nature that they may not fit into a uniform container. For instance, the height of an item may make it impossible to fit into the sliding cartridge package. Such an item may be packaged in a plastic blister package which may be custom formed to enclose the over height article, but yet have edges which may be slid under the magazine track to captivate the over height article in a transparent blister package. Thus packages of unequal height and depth may be packaged with equal facility in a blister package in the main magazine slider track package.

Because of the sliding arrangement, any advertising which appears on the visible surface of the magazine slider package under the "blister" is not destroyed when the blister package is slid out of the magazine. In most of the present day blister packages, the "blister" is tightly secured to the backing board by heat sealing and the separation of the "blister" and the backing board destroys the packaging and any message carried by the backing board. The package may not be conveniently resealed as the blister carton of this invention may be.

Thus, when a magazine is required to receive several non-uniform packages, or articles, they may be held captive in differing custom blister packages that fit in the magazine track slider above and below each other. Each "blister" may be opened without damaging its contents, the track slider, and the "blister".

The marketing of packages (such as shown in FIG. 1) has taken advantage of the shape and the ability to be hung singly from a display rod. However, as time passed and large commercial establishments with the ability to mass market products to the consuming public have developed, alternate means for mass marketing a number of similar product packages simultaneously held together in some acceptable fashion has been sought by the mass marketing organizations. It is to fill this need that the package of this invention was developed.

PRIOR ART

Canadian patent 1,053,189.

SUMMARY OF THE INVENTION

The package of this invention is a package in which other product packages of a uniform shape are inserted for merchandising. The package has an elongated shape and has a pair of parallel slits cut in the front face of the package to form a pair of troughs or slots in the package front. Product packages may be slid from the top of the troughs or slots so formed so that a plurality of product packages may be "loaded" into the package of this invention for commercial display and at the same time forming a neat compact display item. The package itself bearing the loaded product packages or non-uniform "blister" type sliding packages is enveloped in a transparent shrink-wrap sleeve to form a unitary product.

In many ways, the package of this invention functions as a magazine which can be filled in a specific manner with cartridges having a particular shape and size. The packages which are fed into the package magazine of this invention in a serial manner and the cartridge packages are stored in a stacked manner in the parent magazine to form a track sliding package.

The cartridge package is adapted to take advantage of the peculiar shape of modern day cartridge packages to provide a compact finished product where a number of cartridge packages may be easily loaded into the magazine carton and the resultant package may be conveniently displayed in a manner attractive to the consumer.

The cartridge package is a fairly robust packaging carton and does not lend itself to tampering and easy removal of the cartridge packages from a display rack. The package may be supplied with a locking device to prevent easy removal of the cartridge packages or "blisters" captivated on the slider tracks. Because the entire package is enclosed in a transparent shrink wrap type enclosure, tampering is easily detected.

BRIEF DESCRIPTION OF THE DRAWINGS

FIG. 1 shows a product package to be used with this invention.

FIG. 2 is a blank which forms the basic shape of the package of this invention.

FIG. 3 shows the package of this invention formed from the blank of FIG. 2.

FIG. 4 shows the blank of FIG. 3 loaded with the packages of FIG. 1.

DESCRIPTION OF THE PREFERRED EMBODIMENT

Figure 5:
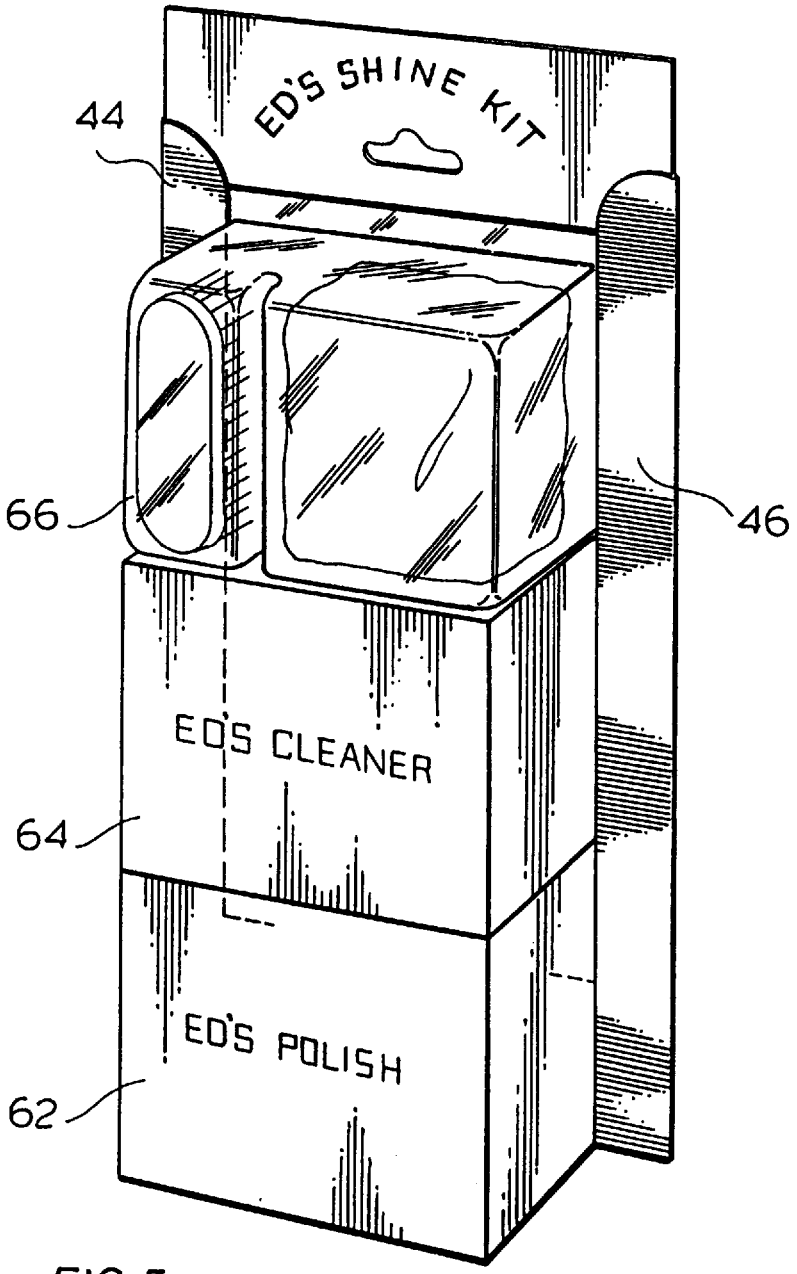
FIG. 5 illustrates a magazine slider package for a combination blister package and standard slider package.

Referring to FIG. 1, a package 10 of a familiar type used in present day marketing and packaging is shown. The package 10, which functions as a cartridge for this invention, has a receptacle portion 12 formed in the usual manner from cardboard and the rear face of the package extends upwardly to form a display or hanging flap 14 of the package 12.

The material forming the flap 14 is merely an extension of the rear face of the carton 12 and the rear flap may be folded over upon itself at fold 16 if it is desired to add more rigidity to flap 14.

The package 10 which forms no part of this invention, is a universal type of product packaging at the present time and an aperture 18 in the flap 14 serves to allow the product package to be suspended from a display hangar.

The blank 20 of FIG. 2 forms the basis of this invention. Blank 20 is formed from a suitable material such as cardboard, kraftboard and is shown having a major face 22, and a pair of side faces or flaps 24 and 26 which are formed by a pair of score lines 28 and 30. The score lines 28 and 30 extend along the complete length of the blank 20 and will subsequently serve as references for folding the blank 20 into a package.

A pair of slits 32 and 34 are cut in blank 20 as shown. Slits 32 and 34 are curved at the top at 35 and 37 and become "L" shaped at the lower extremities in that extensions 36 and 38 are formed at right angles to the main slits 32 and 34.

A pair of apertures 40 and 42 are formed in the top of the blank 10. A cutout 43 is made in the lower part of flap 24 and a tab 47 is cut in the upper part of flap 24.

The blank 10 is folded into the package 50 as shown in FIG. 3. Flap 26 is first folded at score line 30 to overlay the back portion 22 of package 20. Flap 26 is glued to the back 22 along its edge remote from slit 34. Next flap 24 is folded at score line 28 over the back portion 22 and because of the width of flap 24, it will also overlie a portion of flap 26. Flap 24 is glued or otherwise fastened to back portion 22 and side flap 26 by some suitable fastening means.

The package 50 now has substantial thickness due to the folding flaps overlying the rear surface and the aperture 40 overlies aperture 42 so that the package 50 may now be hung on a display hangar.

The slits 32 and 34 now provide a pair of slightly raised lip portions 44 and 46 which form shallow troughs or slots extending from the top curved portions 48 and 49 to the lower slit portions 36 and 38.

The package 50 may now be loaded with product packages such as the package 10 shown in FIG. 1. It is in this manner that package 50 functions as a package "magazine" to store package cartridges 10 in a prescribed manner in the slots provided.

The packages such as 10 are inserted into package 50 so that the extensions 17 and 18 of packages 10 are inserted under lips 44 and 46 at curved portion 48 and 49 into the troughs formed by lips 44 and 46. The package 50 has just sufficient width to receive the packages 10 so that packages 10 may easily be slid downwardly in the troughs formed by lips 44 and 46 and yet not have excessive width to permit lateral movement of packages 10. Flap 47 may be used to "lock" the cartridge packages in place in the magazine. When five of the six cartridge cartons have been slid into blank 50, flap 47 is raised so as to extend over the top edge 16 of the fifth package. The flap 47 is then folded downwardly over the package top, and when the last package (sixth as shown in FIG. 4) is slid into place, tab 47 is held firmly against the upper edge of the fifth package thus preventing easy removal of the cartridge packages in the magazine package 50.

The complete package is shown in FIG. 4. Here, the package 50 is loaded with a plurality of product packages 10 and enclosed in a transparent shrink-wrap to maintain the package integrity.

It will be seen that the packages 10 fit neatly together in the magazine package 50 to form an interlocking chain to provide an attractive compact container which the consuming public may conveniently carry and store for future use.

The container 50 has many advantages. Because of the aperture 42, the container 50 may be hung from a display rod in a commercial establishment. Alternately, the package may stand upright when placed on its lower surface because the lower most package 10 is located so that its surface is flush with the lower edge of package 50.

In this manner, the package 50 may be displayed by either hanging or standing on a sales platform.

FIG. 5 illustrates a package 60 which combines the previous type of package such as packages 62 and 64 which are held captive in the tracks provided by flaps 44 and 46. Also held captive in the same tracks is a blister package 66. This is a transparent package formed so as to be able to hold a product of irregular shape beneath its transparent cover. Blister package 66 has a pair of protruding flat surfaces which fit under the slider flaps 44 and 46 which are integrally attached to the "blister".

Package 60 can be made tamperproof in the same manner as the package shown in FIG. 3 with a locking tab similar to locking tab 47 preventing easy dislodgement of the cartridge packages 62, 64 and 66.

It is also possible to provide a locking aperture placed in a location similar to tab 47 in FIG. 3 for receiving a formed protuberance on the blister package, which protuberance may be pushed through the aperture in the magazine carton to prevent the dislodgement of the cartridge packages by persons of easy virtue. The protuberance may have a bulging head to fit through the provided aperture to work in a similar fashion to a snap fastener.

It will be immediately apparent to those skilled in the art that this magazine package lends itself to mechanical loading and is thus an economical package from a labour conservation viewpoint.

Because of the general acceptance by the consumer of the packages such as 10, this package takes advantage of the peculiarities of the package 10 to form a neat compact, composite package which is virtually tamper proof in that it is immediately evident to the sales and marketing persons that the package has been subjected to maltreatment. The package may be any length that is deemed convenient and because of the overlapping of flaps 24 and 26, the package is rigid and robust. The package permits the upper portion 14 of the topmost package of the product packages 10 to be displayed so that the merchandising establishments commercial message is prominently displayed to the consumer. This commercial message is reinforced by the presence of many identical messages displayed on the fronts of the aligned product packages stacked one upon the other below the top commercial message.

Alternations are possible to the package 50 but applicant prefers to limit coverage of his invention by the scope of the following claims.

I claim:

1. A foldable blank for a container package formed from a suitable material having the general shape of a rectangle said blank having a top and bottom and a pair of sides said blank having a pair of spaced substantially parallel scorelines extending from the top to the bottom of said blank to produce three portions, a central portion of slightly elongated rectangular shape joined at each scoreline to a first and second side portion each side portion having a slit cut therein which is the mirror image of the slit cut in the opposing side portion, each slit extending outwardly a short distance from the scoreline at a point near the top of said blank and thence extending in a direction parallel to said scoreline toward the bottom of said blank, each slit being terminated at the lower end of the slit by extending the slit in an orthogonal direction a short distance away from the scoreline.

2. A foldable carton blank as claimed in claim 1 wherein the first side portion is of a rectangular shape and having a width slightly less than said central portion, and said second side portion has a width slightly less than said first side portion.

3. A foldable carton blank as claimed in claim 2 which is constructed into a carton by folding at said scorelines so that said second side portion is folded over said central portion and fastened to said central portion by suitable fastening means, and said first portion is subsequently folded over said central portion and fastened to the central portion and said second portion by suitable fastening means.

4. A foldable carton blank as claimed in claim 3 which when constructed into a carton produces a pair of shallow troughs are formed by said slits in said folded side portions.

5. A foldable carton blank as claimed in claim 4 which has a locking tab formed near the top of the central portion of said blank.

6. A foldable carton blank as claimed in claim 4 having an aperture formed near the top of said carton blank to provide means to hang said carton blank.

7. In combination a container magazine and a plurality of similarly shaped photographic film packages held in a stacked relationship in said container magazine, said container magazine having a pair of vertically extending slots formed in the front surface of said container package, said slots being formed by a pair of slightly upraised lips extending in a parallel direction along the front surface of said container package, so that each lip extends in a direction parallel to the edge of the container magazine package, from a point near the top of said container magazine package to a point slightly above the bottom of said container magazine package, said photographic film packages each having the shape of a box having four sides and two ends and wherein one side of each photographic film package is extended to form a flat flap which is coplanar with said one side of each photographic film package, said flap having a pair of symmetrical protrusions extending beyond the ends of each package said photographic film package protrusions being provided for receipt in said pair of vertically extending slots formed in the front surface of said container package.

8. A container magazine package as claimed in claim 7 wherein the inside edges of said slightly raised lips are curved outwardly at the top of said container magazine package.

9. A container magazine package as claimed in claim 7 wherein said container magazine package has a locking tab formed near the top of said container magazine package to engage one of the top most film packages to prevent easy removal of the film packages from the slots of said container magazine package.

10. A container magazine as claimed in claim 7 wherein said container magazine package has a locking aperture located near the top of said container magazine package in which a locking projection of one of the film packages may be secured to prevent easy removal of the film packages from said container magazine package.

11. In combination a container magazine package holding a plurality of similarly shaped photographic film packages each having a pair of opposing projecting tabs received in a pair of sliding tracks formed in the front surface of said container magazine package, said tracks being formed by a pair of slightly upraised lips extending from the edges of said container magazine package inwardly a short distance toward the center of the package, so that the inside edge of each lip extends in a direction parallel to the edge of said container magazine package to a point slightly above the bottom of said container magazine package, said tracks being closed at the bottom to prevent the escape of film packages engaged in said tracks.

* * * * *